US007778585B2

(12) United States Patent
Uchida et al.

(10) Patent No.: US 7,778,585 B2
(45) Date of Patent: Aug. 17, 2010

(54) ELECTROPHOTOGRAPHIC CLEANING BLADE, PROCESS FOR PRODUCING ELECTROPHOTOGRAPHIC CLEANING BLADE, AND ELECTROPHOTOGRAPHIC APPARATUS

(75) Inventors: Toshiro Uchida, Toride (JP); Shoji Inoue, Ushiku (JP); Taku Hatanaka, Moriya (JP)

(73) Assignee: Canon Kasei Kabushiki Kaisha, Tsukuba-Shi (JP)

( * ) Notice: Subject to any disclaimer, the term of this patent is extended or adjusted under 35 U.S.C. 154(b) by 182 days.

(21) Appl. No.: 12/181,445

(22) Filed: Jul. 29, 2008

(65) Prior Publication Data

US 2009/0041519 A1 Feb. 12, 2009

(30) Foreign Application Priority Data

Aug. 10, 2007 (JP) ..... 2007-209227

(51) Int. Cl.
*G03G 21/00* (2006.01)

(52) U.S. Cl. ..... 399/350; 399/351

(58) Field of Classification Search ..... 399/107, 399/110, 123, 343, 350, 351; 15/256.5, 256.51
See application file for complete search history.

(56) References Cited

U.S. PATENT DOCUMENTS 6,282,401 B1 * 8/2001 Proulx et al. ..... 399/350
6,703,472 B2 3/2004 Miura et al.
7,254,364 B2 * 8/2007 Nakayama ..... 399/345
2006/0216526 A1 9/2006 Tomiyama et al. ..... 428/423.1
2006/0229425 A1 10/2006 Inoue et al.
2008/0260440 A1 10/2008 Mochizuki et al.

FOREIGN PATENT DOCUMENTS

JP 2001-343874 A 12/2001
JP 2003-122222 A 4/2003
JP 2004-280086 A 10/2004
JP 2007-52062 A 3/2007

OTHER PUBLICATIONS

Office Action dated Dec. 25, 2009, in counterpart Chinese Application No. 200810134925X.

* cited by examiner

*Primary Examiner*—Hoan Tran
(74) *Attorney, Agent, or Firm*—Fitzpatrick, Cella, Harper & Scinto

(57) ABSTRACT

An electrophotographic cleaning blade is provided which is free of blade turning-up coming from both end portions of the blade in its lengthwise direction. The cleaning blade having a blade formed of a polyurethane resin, which is to come into touch with the surface of a photosensitive drum of an electrophotographic apparatus to remove a toner remaining thereon, and a support member which holds the blade. The blade has a polyurethane resin portion having a dynamic hardness of 0.05 mN/μm$^2$ or more and 0.16 mN/μm$^2$ or less and a high-hardness portion having a dynamic hardness 1.3 times or more and 30 times or less the dynamic hardness of the polyurethane resin portion, provided at each end portion of the blade in its lengthwise direction at its part coming into touch with the photosensitive drum.

4 Claims, 2 Drawing Sheets

ELECTROPHOTOGRAPHIC CLEANING BLADE, PROCESS FOR PRODUCING ELECTROPHOTOGRAPHIC CLEANING BLADE, AND ELECTROPHOTOGRAPHIC APPARATUS

BACKGROUND OF THE INVENTION

1. Field of the Invention

This invention relates to an electrophotographic cleaning blade (cleaning blade for electrophotography) for removing toner remaining on an image bearing member (photosensitive drum), a transfer belt, an intermediate transfer member and so forth, used in an electrophotographic apparatus, and relates to an electrophotographic apparatus to which the cleaning blade is applied.

2. Description of the Related Art

The electrophotographic apparatus is provided with various cleaning blades for removing toner remaining on an image bearing member (photosensitive drum), a transfer belt, an intermediate transfer member and so forth. The blades of such cleaning blades are produced using a thermoplastic or thermosetting polyurethane resin or the like. From the viewpoint of plastic deformation and wear resistance, they are produced chiefly using a thermosetting polyurethane resin.

However, where a conventional blade made of a polyurethane resin is used, the coefficient of friction between polyurethane resin and the photosensitive drum is so large that the blade may turn up or the driving torque of the photosensitive drum is required to be made large. It may also come about that the leading edge of the blade is entwined by the photosensitive drum or the like and is stretched and cut to chip away. Such problems remarkably arise especially when the blade has low hardness, so that it may become insufficient in durability. On the other hand, when the blade has high hardness, it may scratch the photosensitive drum during operation.

To resolve such problems the blade made of a polyurethane resin has, a cleaning blade and a production process thereof are proposed where the cleaning blade is provided with a cured layer of 0.12 to 1.2 mm in thickness where the blade comes into contact with the photosensitive drum (e.g., Japanese Patent Laid-open Application No. 2001-343874). The cured layer is provided by allowing the polyurethane resin that is the base material of the blade to react with an isocyanate compound.

Further analyses made in detail in respect of the blade turning-up and chipping of the cleaning blade have revealed that the blade tends to turn up more at both end portions in its lengthwise direction. The reason therefor is that both end portions of a photosensitive drum correspond positionally to blank areas on both sides of a recording sheet and hence no image is formed there. Thus, in the areas where no image is formed, the amount of toner remaining on the photosensitive drum surface comes to be extremely small, and hence the slipperiness of the blade locally deteriorates only in such areas and the turning-up is liable to occur at both end portions.

It is effective in inhibiting the turning-up that, as in the past, the hardness of the blade is increased in the whole region of the part coming into contact with the photosensitive drum. However, there is a risk that blades whose contact portions are rough are produced in the production process. When taking a countermeasure against that, the process of removing the isocyanate compound inevitably increases, and a rise in material costs is brought about by increasing the hardness of the whole region of the part coming into contact with the photosensitive drum (e.g., Japanese Patent Laid-open Application No. 2004-280086).

On the contrary, even if the blade becomes rough to a certain extent at contact portions, there is no possibility of causing a problem as long as the touch portions fall within the end regions where no image is formed, i.e., regions other than what is called an image formation region. Accordingly, the cured layer is formed only at both end portions of the blade, so that it is considered that the step of removing an excess isocyanate compound can be simplified and material costs can be reduced, achieving good productivity and enabling the blade to be effectively prevented from turning up.

Hitherto, a method has been proposed in which the cured layer is provided only at both end portions of the blade (e.g., Japanese Patent Laid-open Application No. 2003-122222). However, Japanese Patent Laid-open Application No. 2003-122222 does not specify the hardness of the cured layer. There are risks that the blade turns up if the hardness is low and the photosensitive drum is scratched if the hardness is too high.

SUMMARY OF THE INVENTION

Accordingly, a subject of the present invention is to provide an electrophotographic cleaning blade free of a blade turning-up condition that comes from both end portions of the blade in its lengthwise direction, a process for producing such an electrophotographic cleaning blade, and an electrophotographic apparatus in which the electrophotographic cleaning blade is set.

The above subject is achieved by an electrophotographic cleaning blade having a blade formed from a polyurethane resin, which comes into contact with the surface of a photosensitive drum of an electrophotographic apparatus to remove toner remaining thereon, and a support member which holds the blade, wherein the blade has a polyurethane resin portion having a dynamic hardness of 0.05 $mN/\mu m^2$ or more and 0.16 $mN/\mu m^2$ or less and a high-hardness portion having a dynamic hardness of 1.3 times or more and 30 times or less the dynamic hardness of the polyurethane resin portion, provided at both end portions of the blade in its lengthwise direction at its part coming into contact with the photosensitive drum.

The present invention can provide an electrophotographic cleaning blade in which slipperiness at both end portions of the blade where it comes into contact with a photosensitive drum is improved and a blade turning-up coming from both end portions is inhibited from occurring, and an electrophotographic apparatus in which the electrophotographic cleaning blade is set.

Further features of the present invention will become apparent from the following description of exemplary embodiments with reference to the accompanying drawings.

DESCRIPTION OF THE EMBODIMENTS

The electrophotographic cleaning blade of the present invention includes a blade formed of a polyurethane resin, which is brought into contact with the surface of a photosensitive drum of an electrophotographic apparatus to remove toner remaining thereon, and a support member which holds the blade. This blade is characterized by having a polyurethane resin portion having a dynamic hardness of 0.05 $mN/\mu m^2$ or more and 0.16 $mN/\mu m^2$ or less. This blade is further characterized by having, at both end portions of the blade in its lengthwise direction where it comes into contact with the photosensitive drum, a high-hardness portion having a dynamic hardness from 1.3 times or more and 30 times or less the dynamic hardness of the polyurethane resin portion.

The electrophotographic cleaning blade of the present invention has, as mentioned above, a blade formed of a polyurethane resin and a support member which holds the blade.

There are no particular limitations on the support member used in the present invention. Usually, a support member made of a metal, a hard plastic or the like may preferably be used.

The blade in the present invention may usually preferably be a blade having a rectangular shape, but there are no particular limitations on the shape as long as the blade can, at its contact portion, where it comes into contact with and rubs against the photosensitive drum to wipe off toner remaining on the photosensitive drum surface.

Figure 1A:
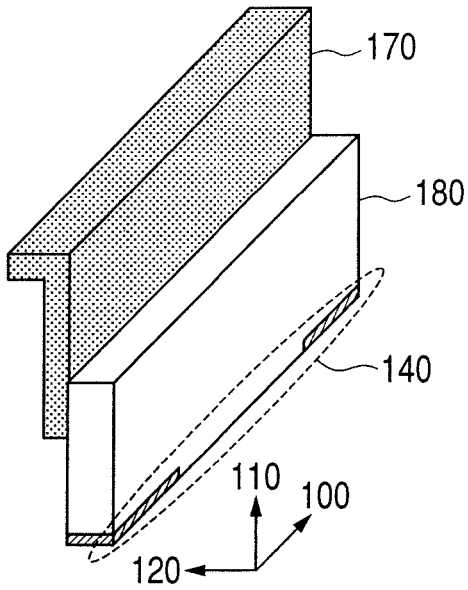
FIGS. 1A and 1B are diagrammatic views for illustrating the cleaning blade of the present invention.
Figure 1B:
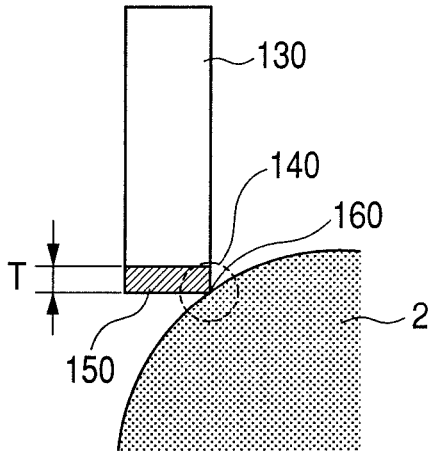

FIGS. 1A and 1B show an example of an embodiment of the electrophotographic cleaning blade of the present invention.

The electrophotographic cleaning blade embodied as shown in FIGS. 1A and 1B has a blade 180 formed of a polyurethane resin and a support member 170 which holds the blade 180. The blade 180 has a rectangular shape extending in the lengthwise direction 100 and free-length direction 110.

A high-hardness portion 150 having a rectangular sectional shape extending in the free-length direction 110 and thickness direction 120 of the blade is formed at each end portion of the blade in its lengthwise direction 100 at a part 140 where it comes into contact with the photosensitive drum, in which an edge portion 160 of the blade is included. In the present invention, a portion 130 of the blade 180 exclusive of the high-hardness portion 150 is called a polyurethane resin portion.

In FIG. 1B, letter symbol T denotes the thickness of the high-hardness portion 150. The high-hardness portion 150 usually looks white opaque, and hence the thickness of the part looking like this may be regarded as the thickness of the high-hardness portion when the thickness of the high-hardness portion is measured. The high-hardness portion 150 also has a dynamic hardness higher than the polyurethane resin portion 130. Accordingly, the portion having a higher dynamic hardness than the polyurethane resin portion may be regarded as the high-hardness portion and the thickness thereof may be measured. Herein, the free length refers to the length of the blade protruding from the support member in the free-length direction 110, and is commonly preferably from 5 to 15 mm.

The thickness T of the high-hardness portion is usually preferably 0.05 mm or more because, if it is too thin, there is a possibility that the blade is reduced in durability, and is more preferably 0.1 mm or more. The thickness of the high-hardness portion is preferably 0.8 mm or less. As long as the thickness of the high-hardness portion is within such a range, the blade can maintain good surface properties over a long period of time even if the surface portion comes into contact with the photosensitive drum has worn. Further, since the high-hardness portion has a sufficient thickness, the blade surface can be inhibited from being greatly deformed due to rubbing against the photosensitive drum, thus even fine-particle toner or spherical-particle toner often used in recent years can effectively be removed.

There are no particular limitations on the width of the high-hardness portion 150 in the lengthwise direction 100, which is provided at each end portion of the blade 180 in its lengthwise direction where it comes into contact with the photosensitive drum Usually, the high-hardness portion is preferably in a width inclusive of the width of each end portion of the blade that comes into contact with each side region outside the image formation region of the photosensitive drum. Usually, the width of the high-hardness portion 150 in the lengthwise direction is preferably about 15 mm.

The dynamic hardness of the high-hardness portion (herein referred to also as "HH") is preferably 1.3 times or more and 30 times or less, and more preferably 1.5 times or more and 15 times or less, as high as the dynamic hardness of the polyurethane resin portion (herein referred to also as "HU"). In the present invention, a magnifying power of the high-hardness portion dynamic hardness HH to the polyurethane resin portion dynamic hardness HU, HH divided by HU, is represented in terms of a ratio of the dynamic hardness of the high-hardness portion to that of the polyurethane resin portion (HH/HU). If the dynamic hardness of the high-hardness portion is less than 1.3 times the dynamic hardness of the polyurethane resin portion, the friction of the blade against the photosensitive drum is so high that the blade is liable to turn up. On the other hand, if the magnifying power is more than 30 times, the high-hardness portion at each end portion of the blade may come off the blade or the photosensitive drum tends to be scratched by the blade.

When the blade formed from a polyurethane resin is provided with a high-hardness portion, the dynamic hardness of the part provided with the high-hardness portion (i.e., the high-hardness portion) increases. Hence, if the dynamic hardness of the polyurethane resin portion of the blade is too high, there is a possibility that the dynamic hardness of the formed high-hardness portion becomes too high. Accordingly, the blade in the present invention is required to have a dynamic hardness of 0.05 $mN/\mu m^2$ or more and 0.16 $mN/\mu m^2$ or less at the polyurethane resin portion of the blade. This dynamic hardness is preferably 0.07 $mN/\mu m^2$ or more, and more preferably 0.14 $mN/\mu m^2$ or less. The blade having the polyurethane resin portion with the above-mentioned dynamic hardness is flexible and rich in rubber elasticity as a whole. Thereby, good adhesiveness can be achieved between the photosensitive drum and the electrophotographic cleaning blade, and the photosensitive drum can be inhibited from being damaged by the electrophotographic cleaning blade.

When the blade formed of a polyurethane resin is provided with a high-hardness portion, the international rubber hardness degree (IRHD) of the high-hardness portion (i.e., its high-hardness portion) increases. Hence, if the international rubber hardness degree of the polyurethane resin portion of the blade is too high, there is a possibility that the international rubber hardness degree of the formed high-hardness portion becomes too high. If the international rubber hardness degree of the high-hardness portion is too high, the photosensitive drum may be scratched by the blade, and hence the polyurethane resin portion may preferably have an international rubber hardness degree of 60 to 80 IRHD. Inasmuch as the polyurethane resin portion has an international rubber hardness degree of 60 IRHD or more, the blade can not easily turn up. Inasmuch as it has an international rubber hardness degree of 80 IRHD or less, the photosensitive drum cannot easily be scratched by the blade.

In the electrophotographic cleaning blade of the present invention, the high-hardness portion is, as described previously, formed only at each end portion of the blade in its lengthwise direction 100 where it comes into contact with the photosensitive drum Hence, the rubber elasticity of the blade 180 is retained at the polyurethane resin portion where the high-hardness portion is not formed. Thus, the blade 180 can be kept from having too high rigidity as a whole, can have good performance adaptable to the photosensitive drum, and can have superior cleaning performance. The blade can also have good close-contact performance between the blade and the photosensitive drum, so that the photosensitive drum can be kept from being scratched by the blade.

The blade in the present invention may have a thickness commonly adopted for electrophotographic cleaning blades. Usually, it may preferably have a thickness of approximately from 0.5 mm to 3 mm.

Inasmuch as the high-hardness portion is provided, the friction of the electrophotographic cleaning blade of the present invention against the photosensitive drum is greatly reduced. The degree of the friction of the blade against the photosensitive drum may appropriately be controlled by the thickness of the high-hardness portion. More specifically, as the thickness of the high-hardness portion increases, the friction coefficient gradually decreases. The high-hardness portion may preferably have a coefficient of friction of 2.0 or less, and more preferably 1.5 or less, from the viewpoint of the sliding properties of the electrophotographic cleaning blade. In addition, as the thickness of the high-hardness portion increases, the friction coefficient decreases. However, the rubber elasticity of the blade may become too low to clean the photosensitive drum surface. Hence, the high-hardness portion and the friction coefficient may appropriately be controlled depending on how the blade is set (contact angle and penetration, i.e., depth of indentation), how the photosensitive drum is set and how the electrophotographic apparatus is constructed.

Next, it will be described how to produce the cleaning blade of the present invention.

Molding of Blade

The cleaning blade of the present invention is formed from a polyisocyanate compound and a polyfunctional active-hydrogen compound.

As the polyisocyanate compound in the present invention, it is preferable to use a prepolymer or a semi-prepolymer obtained by allowing usual polyisocyanate to react with a high-molecular polyol that is a polyfunctional active-hydrogen compound. Such a prepolymer or semi-prepolymer may preferably have an isocyanate group content (NCO %) of from 5 to 20% by mass in order to achieve good elastic properties The isocyanate group content (NCO %) refers to a percent by mass of isocyanate groups (NCO; molecular weight is calculated as 42) contained in the prepolymer or semi-prepolymer that is the raw material of a polyurethane resin. In the present invention, the isocyanate group content (NCO %) is calculated according to the following expression:

$$\text{NCO \%} = (\text{isocyanate functional group equivalent weight in 100 g}) \times 42.$$

The polyisocyanate used usually to prepare the polyisocyanate compound such as the prepolymer or semi-prepolymer includes diphenylmethane diisocyanate (MDI), tolylene diisocyanate (TDI), naphthalene diisocyanate (NDI) and hexamethylene diisocyanate (HDI) The high-molecular polyol that is an active-hydrogen compound for preparing the prepolymer or semi-prepolymer includes polyester polyols, polyether polyols, caprolactone ester polyols, polycarbonate ester polyols, and silicone polyols, which preferably have a weight average molecular weight of from 500 to 5,000.

Specific examples of a cross-linking agent usable include 1,4-butanediol, 1,6-hexanediol, ethylene glycol and trimethylol propane.

When reacting the polyisocyanate with the high-molecular polyol and the cross-linking agent, a usual catalyst used to form a polyurethane resin may be added. Such a catalyst includes triethylenediamine.

In the present invention, the polyurethane resin portion of the cleaning blade is set to have a dynamic hardness of 0.05 $mN/\mu m^2$ or more and 0.16 $mN/\mu m^2$ or less.

The blade formed of a polyurethane resin in the present invention may be molded by a method including (a) a one-shot method in which the high-molecular polyol, the polyisocyanate, the cross-linking agent and the catalyst are mixed at a time and injected into a mold or a centrifugal molding cylindrical mold to be cast, (b) a prepolymer method in which the high-molecular polyol and the polyisocyanate are preliminarily reacted to produce a prepolymer, followed by mixing with the cross-linking agent and the catalyst, and the resulting mixture is injected into a mold or a centrifugal molding cylindrical mold to be cast, and (c) a semi-one-shot method in which a semi-prepolymer obtained by reacting the polyisocyanate with the high-molecular polyol is reacted with a curing agent obtained by adding the high-molecular polyol to the cross-linking agent, and the reaction product obtained is injected into a mold or a centrifugal molding cylindrical mold to be cast.

Alternatively, a polyurethane resin sheet having a necessary thickness is beforehand prepared, and is cut in the shape of a blade to produce the blade formed of a polyurethane resin.

When any one of the methods (a) to (c) is used, the blade formed of a polyurethane resin may be formed directly on the support member to prepare a cleaning blade not provided with the high-hardness portion, and thereafter this blade may be provided with the high-hardness portion. Instead, a method as described below may be used to form the high-hardness portion in the blade formed of the polyurethane resin, and thereafter the support member may be attached to the blade to set up the electrophotographic cleaning blade.

In order to prepare the blade with a good precision where it comes into contact with the photosensitive drum, the leading edge of the blade formed of a polyurethane resin may be cut.

Formation of High-Hardness Portion

Next, it will be described how to form the high-hardness portion in the blade formed of a polyurethane resin, obtained as above.

In the present invention, the high-hardness portion may preferably be formed by impregnating the blade formed of a polyurethane resin with an isocyanate compound.

As a process for forming the high-hardness portion, one is cited having the following steps: (1) the step of bringing an isocyanate compound into contact with each end portion of the blade formed of a polyurethane resin, in its lengthwise direction where it comes into contact with the photosensitive drum; (2) the step of impregnating said portion of the blade with the isocyanate compound by allowing it to stand in the state that the isocyanate compound is kept in contact with the blade surface; (3) the step of removing, after the impregnation, the isocyanate compound remaining on the surface of the blade; and (4) the step of reacting and curing the isocyanate compound impregnated into the blade to form the high-hardness portion.

That is, in the steps (1) and (2), the blade formed of the polyurethane resin is impregnated with the isocyanate compound in a suitable quantity at each end portion the blade in its lengthwise direction where it comes into contact with the photosensitive drum. In the step (3), an excess isocyanate compound is removed from the surface of the blade, and in the step (4), the impregnated isocyanate compound is reacted and cured to form the high-hardness portion.

It is considered that in the step (4), the polyurethane resin forming the blade and the isocyanate compound are reacted with each other to form allophanate linkages for curing to form the high-hardness portion.

More specifically, it is considered that urethane linkages having active hydrogen are present in the polyurethane resin from which the blade is formed, and in the step (4), the urethane linkages and the impregnated isocyanate compound react with each other to form the allophanate linkages, whereby the high-hardness portion is formed. It is also considered that polymerization reaction (e.g., carbodiimidization reaction or isocyanulation reaction) due to mutual reaction of the isocyanate compound proceeds simultaneously to contribute to the formation of the high-hardness portion. As a result, the hardness of the high-hardness portion is sufficiently increased, and the friction coefficient is sufficiently reduced, thus the blade can be improved in durability.

As the isocyanate compound with which the blade is to be impregnated, an isocyanate compound having one isocyanate group per molecule and an isocyanate compound having two or more isocyanate groups per molecule can be used. The isocyanate compound having one isocyanate group per molecule includes aliphatic monoisocyanates such as octadecyl isocyanate (ODI), and aromatic monoisocyanates.

The isocyanate compound having two isocyanate groups per molecule with which the blade is to be impregnated includes 2,4-tollylene diisocyanate, 2,6-tollylene diisocyanate, 4,4'-diphenylmethane diisocyanate (MDI), m-phenylene diisocyanate, tetramethylene diisocyanate and hexamethylene diisocyanate.

As the isocyanate compound with which the blade is to be impregnated, the following may be used: a isocyanate compound having three or more isocyanate groups per molecule, such as 4,4',4"-triphenylmethane triisocyanate, 2,4,4'-biphenyl triisocyanate, and 2,4,4'-diphenylmethane triisocyanate, and modified derivatives, oligomers or the like of the isocyanate compound having two or more isocyanate groups per molecule.

Of the isocyanate compounds exemplified above, aliphatic isocyanate compounds having less steric hindrance and isocyanate compounds having a small molecular weight have superior penetrability, and hence make it easy to control the thickness of the high-hardness portion. On the other hand, isocyanate compounds having a large molecular weight have inferior penetrability, but have a long chain. Hence, they are less in volatility and are relatively low in toxicity, and thus, are superior in operation safety at the time of manufacture.

In the present invention, with the aim of accelerating the reaction of the isocyanate compound, the catalyst in addition to the isocyanate compound may be impregnated into a polyurethane resin.

The catalyst used together with the isocyanate compound includes quaternary ammonium salts and carboxylates. The quaternary ammonium salts may be exemplified by TMR catalysts, available from Dabco, Inc. The carboxylates may be exemplified by potassium acetate and potassium octylate. These catalysts are very viscous or in the form of solids at the time of impregnation. Hence, after having been dissolved in a solvent, these may preferably be added to the isocyanate compound and impregnated into the polyurethane resin.

In the present invention, when the blade formed of a polyurethane resin is impregnated with the isocyanate compound, the blade may be by itself, or may be jointed to the support member. Where the blade is produced by beforehand preparing a sheet formed of the polyurethane resin and then cutting a blade from the sheet, the high-hardness portion may be formed in the following way. That is, the sheet having not been cut is impregnated with the isocyanate compound and reacted for curing, and thereafter, is cut into the blade having the high-hardness portion at each end portion. The region of the blade to be impregnated with the isocyanate compound has the part where the blade where it comes into contact with the photosensitive drum.

The blade may be impregnated with the isocyanate compound by, e.g., a method in which the blade is coated with the isocyanate compound using a fibrous member or a porous member into which the isocyanate compound is impregnated and the blade is coated therewith or a method in which the blade is sprayed with the isocyanate compound.

In this way, the blade is impregnated with the isocyanate compound for a stated time. In order that the high-hardness portion of the blade finally obtained can have thickness within the desired range, the blade formed of a polyurethane resin is brought into contact with the isocyanate compound for a contact time period of preferably 5 minutes or more, and more preferably 10 minutes or more. The contact time is preferably 1 hour or less, and more preferably 40 minutes or less in view of mass productivity.

Impregnation temperature is preferably room temperature so as to make it unnecessary to use any heating means. Hence, a contact angle of the isocyanate compound to the polyurethane resin portion is preferably 50° or less (at a temperature of 25° C.), and more preferably 40° or less.

Then, in the step (3), some isocyanate compound remaining on the blade surface is wiped off by using a solvent capable of dissolving the isocyanate compound. After the impregnation, if the isocyanate compound remaining in excess is not uniformly removed, slight protrusions come about on the surface of the high-hardness portion, and the toner escapes from the peripheries of the protrusions when the toner remaining on the photosensitive drum is removed by the cleaning blade, resulting in faulty cleaning.

Accordingly, the step is required in which the isocyanate compound adhered to the blade surface is sufficiently removed by using the solvent capable of dissolving the isocyanate compound. The solvent usable for the above includes, e.g., toluene, xylene, butyl acetate and methyl ethyl ketone.

As a means for removing the adhered isocyanate compound, one is available in which, e.g., a sponge or the like which is not so hard as to scratch the blade formed of a polyurethane resin is soaked with the solvent and the excess isocyanate compound adhered to the blade surface is wiped off. If the solvent is used in excess, the isocyanate compound impregnated into the blade formed of the polyurethane resin is extracted, so that the high-hardness portion cannot stably be formed in some cases. Accordingly, e.g., it is preferable to provide the step of removing most of the isocyanate compound adhered to the surface by using a wiping blade. Such a preliminary removal step is carried out to remove most of the excess isocyanate compound adhered to the surface, and thereafter the step of removing the isocyanate compound adhered to the surface is carried out by using a sponge or the like soaked with the solvent in a bare minimum quantity. This enables more preferable surface properties to be achieved.

After passing through the above steps, in the step (4), the impregnated isocyanate compound is allowed to react with the polyurethane resin to form the allophanate linkages, and also to react with water in the air to be almost consumed, thus a blade can be obtained in which the white opaque high-hardness portion has been formed, and the surface is flat and smooth.

In this case, with the intention of accelerating the reaction, heating may be carried out. The reaction temperature is usually preferably 30° C. or more and 140° C. or less. The reaction time is preferably 5 minutes or more and 100 minutes or less from the viewpoint of reaction efficiency and prevention of heat deterioration in the polyurethane resin.

The high-hardness portion thus formed may preferably have a ten-point average roughness Rz-jis (JIS B 0601-2001) of 5 μm or less at its part where it comes into contact with the photosensitive drum.

With an increase in the thickness of the high-hardness portion, the degree of friction of the blade against the photosensitive drum is gradually reduced in comparison with a blade not provided with any high-hardness portion. Accordingly, the thickness of the high-hardness portion can be adjusted by controlling the reaction of the polyurethane resin with the isocyanate compound, to thereby regulate the friction coefficient.

In the present invention, the high-hardness portion is formed with a bare minimum thickness, and hence the blade can retain rubber elasticity at its leading edge. Thus, the blade can be kept from having too high of a rigidity as a whole, can have good performance adaptable to the photosensitive drum, and can have superior cleaning performance. Also, the good close-contact performance is achieved between the blade and the photosensitive drum, so that the photosensitive drum can be kept from being scratched by the blade.

As described above, the present invention can also provide a process for producing the cleaning blade which has superior surface smoothness while maintaining good cleaning performance and durability, and has high hardness with a low coefficient of friction at each end portion of the blade in its lengthwise direction at its part coming into contact with the photosensitive drum.

Electrophotographic Apparatus

Figure 3:
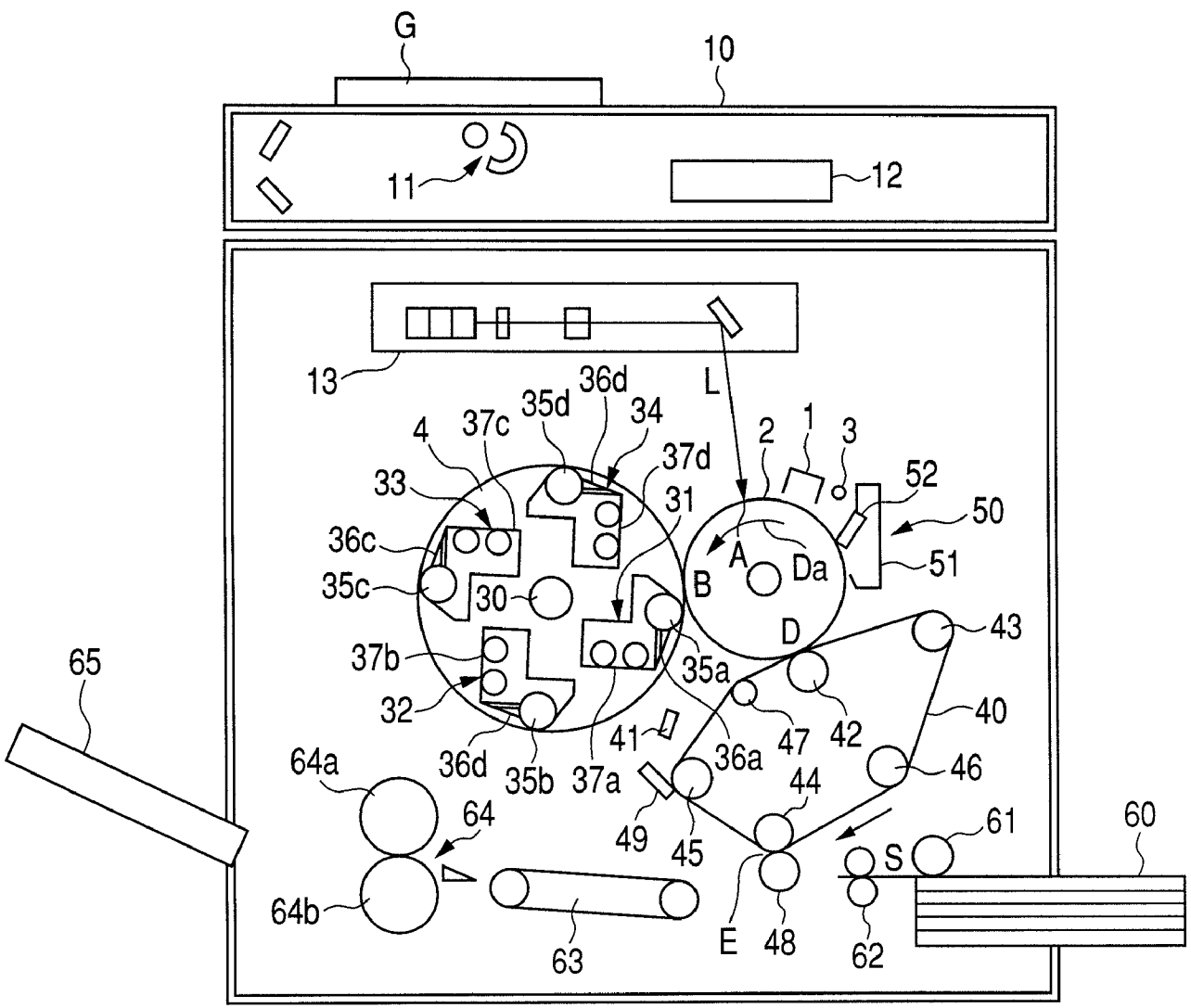
FIG. 3 is a schematic view of an example of an electrophotographic apparatus in which the cleaning blade of the present invention is set.

An example of an electrophotographic apparatus in which the cleaning blade of the present invention is set, is shown in FIG. 3 as a schematic view. This electrophotographic apparatus has a photosensitive member 2, a charging assembly 1 that is a charging means and an ROS (latent image writing unit) 13 that is an exposure means. It further has a developing rotary unit 4 having four developing assemblies 31 to 34 that is a developing means, an intermediate transfer belt 40 and a secondary transfer assembly 48 that constitute a transfer means, a cleaner 5 that is a cleaning means, a pre-exposure unit 3 that is a de-charging means, and a fixing assembly 64. It still further has a sheet transport system consisting of a paper feed tray 60, a pick-up roll 61, a registration roll pair 62, a sheet transport belt 63, a recording sheet take-off tray 65, etc.

An image reading means has an original stand glass 10, a light source 11 which emits light toward the original stand glass 10, and a CCD 12 which converts the light reflected from an original placed on the original stand glass 10 into electrical signals of red (R), green (G) and blue (B). The electrical signals of the R, G and B outputted from the CCD 12 are received by an IPS (image processing system) (not shown). Then, they are converted into image data of black (K), yellow (Y), magenta (M) and cyan (C), where electrical signals corresponding to the images thus converted are outputted to a laser beam emitting unit, and laser beams with intensity corresponding thereto are outputted from the latent image writing unit 13. In FIG. 3, an original G is placed on the original stand glass 10.

The developing assembly 31 has a developer container 37*a* which holds a K (black) two-component developer, a developing sleeve 35*a* so provided as to be rotatable at an opening of the developer container 37*a*, and a control blade 36*a* which controls the developer carried on the developing sleeve 35*a*. The control blade 36*a* regulates the height of ears of a magnetic brush formed on the sleeve. The developing assembly 31 further has a rotating rod which agitates the developer held in the developer container 37*a*, and a power source (not shown) which applies a voltage to the developing sleeve 35*a* at the time of development. Inside the developing sleeve 35*a*, a magnet (not shown) is set stationary which has a plurality of magnetic poles. A Y (yellow) developer, an M (magenta) developer and a C (cyan) developer are held in the developing assembly 32, the developing assembly 33 and the developing assembly 34, respectively, which are set up in the same way as in the developing assembly 31 except for the developers held therein.

The developing assemblies 31 to 34 are provided in the developing rotary unit 4 so set as to be rotatable. The developing rotary unit 4 has a rotating shaft 30 and is rotated around the shaft so that a developing assembly corresponding to color data of electrostatic latent images can be transported to a developing zone B, and constitutes a rotary type developing means. The developing sleeves 35*a* to 35*d* are arranged by this developing rotary unit 4, and are so placed as to be able to develop the electrostatic latent images in the state that the magnetic brush on each developing sleeve comes into contact with the photosensitive member 2.

Below the surface of the photosensitive member 2, the intermediate transfer belt 40 and a plurality of belt support rollers are provided with the belt support rollers including a belt drive roller 45, a tension roller 43, idler rollers 46 and 47 and a back-up roller 44 for secondary transfer. Further, the following are provided: a primary transfer roller 42, belt frames (not shown) which support these rollers, and a blade type belt cleaner 49 which is to remove residual toners adhered to the intermediate transfer belt 40 before transfer.

At a position set apart from the intermediate transfer belt 40, a position sensor 41 is provided which detects the home position provided at a non-transfer area of the transfer intermediate transfer belt 40. At a position opposite to the back-up roller 44 for secondary transfer with the intervention of the intermediate transfer belt 40, the secondary transfer assembly 48 is provided to transfer the intermediately transferred toner images to a recording sheet as a transfer material.

The photosensitive-member cleaner 50 has a cleaning blade 52 coming into contact with the surface of the photosensitive member 2, and a cleaning container 51 which holds the cleaning blade 52 and receives toner particles removed by the cleaning blade 52.

The photosensitive member 2 is rotated in the direction of an arrow Da, and the surface of the photosensitive member is uniformly charged by the charging assembly 1, and at a latent image writing position A, is then exposed to and scanned with a laser beam L (dominant wavelength: 655 nm) emitted from the ROS 13, thus the electrostatic latent images are formed thereon. Where full-color images are formed, electrostatic latent images corresponding to K (black), Y (yellow), M (magenta) and C (cyan) four-color images are sequentially formed thereon. In the case of monochrome images, only electrostatic latent images corresponding to K (black) images are formed thereon.

The photosensitive member 2 surface on which the electrostatic latent images have been formed is rotated and moved to sequentially pass through the developing zone B and a primary transfer zone D. The developing assemblies 31 to 34 are transported to the development position by the rotation of the developing rotary unit 4, and convert into toner images the electrostatic latent images formed on the photosensitive member 2 surface passing through the developing zone B.

In the case where full-color images are formed, first-color electrostatic latent images are formed at the latent image writing position A, and first-color toner images are formed at the developing zone B. When passing through the primary transfer zone D, the toner images thus formed are electrostatically primarily transferred onto the intermediate transfer belt 40 by means of the primary transfer roller 42. Thereafter, in the same manner, second-color, third-color and fourth-color toner images are sequentially superimposed and primarily transferred onto the intermediate transfer belt 40 holding thereon the first-color toner images, thus full-color multiple toner images are finally formed on the intermediate transfer belt 40. In the case where monochrome black-and-white images are formed, only the developing assembly 31 is used, and monochrome toner images are primarily transferred onto the intermediate transfer belt 40.

After the primary transfer, the toner remaining on the photosensitive member 2 is removed by the cleaning blade 52.

A recording sheet S held in the paper feed tray 60 is taken out by the pick-up roll 61 at preset timing, and then transported to the registration roll pair 62. The registration roll pair 62 transports the recording sheet S to a secondary transfer zone E in synchronization with the movement of the primarily transferred full-color multiple toner images or monochrome toner images to the secondary transfer zone E. In the secondary transfer zone E, the secondary transfer assembly 48 electrostatically secondarily transfers to the recording sheet S the toner images all together which are held on the intermediate transfer belt 40. The intermediate transfer belt 40 after the secondary transfer is cleaned by the belt cleaner 49, and thus the toner remaining on the belt is removed.

The recording sheet S with the toner images secondarily transferred thereon is transported to the fixing assembly 64 through the sheet transport belt 63, where the toner images are heated and fixed by means of the fixing assembly 64. The recording sheet S with the toner images fixed thereto is discharged to the recording sheet take-off tray 65.

In the electrophotographic apparatus in the present invention, as the cleaning blade 52, the cleaning blade of the present invention is used having a blade provided with the high-hardness portion at each end portion of the blade in its lengthwise direction where it comes into contact with the photosensitive member 2 and a support member which holds the blade, thus an excellent effect is exhibited. The cleaning blade of the present invention can be used also as the belt cleaner 47.

EXAMPLES

The present invention is described below in greater detail by giving Examples. These by no means limit the present invention.

Cleaning blades obtained in the Examples were evaluated on the following items.

(1) International Rubber Hardness Degree

The international rubber hardness degree was measured with an IRHD microhardness meter (Model H12) manufactured by Wallace Co. Ltd., and according to JIS K 6253-1997.

(2) Dynamic Hardness

The dynamic hardness was measured with a Shimadzu Dynamic Ultra-microhardness Meter DUH-W201S (trade name), manufactured by Shimadzu Corporation, under the condition of 23° C. A 115° triangular pyramid indenter was used as an indenter. The dynamic hardness value was found according to the following calculating expression.

$$\text{Dynamic hardness: } DH=\alpha\times P/D^2,$$

wherein $\alpha$ represents a constant according to the shape of the indenter, P represents test force (mN), and D represents penetration (depth of indentation) (μm) of the indenter into a sample.

In this case, the value of $\alpha$ was 3.8584, P=1.0 mN, loading speed is 0.028439 mN/s, and retention time is 5 seconds.

Figure 2:
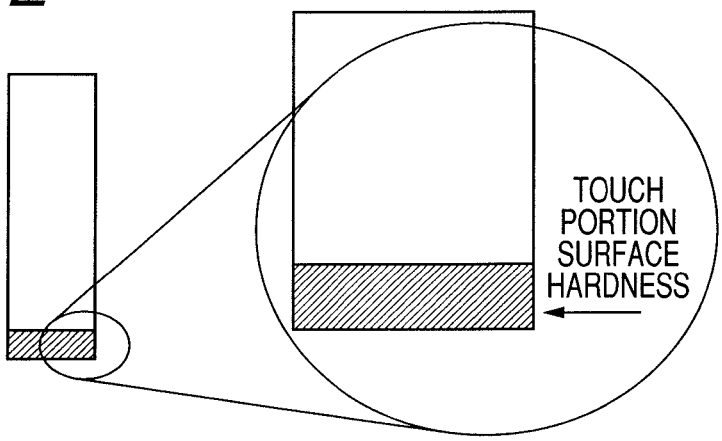
FIG. 2 is a diagrammatic view for illustrating the position where the dynamic hardness in the present invention is measured.

The dynamic hardness of the high-hardness portion was measured at the contact portion shown in FIG. 2 and at three spots in the high-hardness portion positioned at the part 140 which comes into contact with the photosensitive member (photosensitive drum), and was found as an average of measured values. The dynamic hardness of the polyurethane resin portion was measured at three spots in the polyurethane resin portion positioned at the middle of the blade in the lengthwise direction at the part 140 which comes into contact with the photosensitive member (photosensitive drum), i.e., at the portion provided with no high-hardness portion, and was found as an average of measured values.

(3) Ten-Point Average Roughness Rz-jis

The ten-point average roughness Rz-jis was measured at the high-hardness portion of the blade where it comes into contact with the photosensitive drum, by using a surface roughness measuring instrument SURFCORDER SE3500 (trade name), manufactured by Kosaka Laboratory Ltd., according to JIS B 0601-2001).

(4) Coefficient of Friction

Measurement was made using a HEIDON surface property tester, manufactured by Shinto Scientific Co., Ltd., under the conditions of a temperature of 23° C. and a humidity of 50% where a ball indenter made of stainless steel was brought into contact with the high-hardness portion under the application of a load of 0.1 kg and the ball indenter was moved at a rate of 50 mm/minute.

(5) Practical Test

Each of the cleaning blades produced in the Examples was set in a color laser copying machine CLC-5000 (trade name), manufactured by CANON INC., and an actual-copying test was conducted in which an original of 10% in image area percentage was copied on 100,000 sheets in a one-sheet intermittent mode in a normal-temperature and normal-humidity environment, where images obtained on the 100,000th sheet was visually evaluated. An amorphous silicon drum was used as a photosensitive drum of the copying machine to form the images, and a non-magnetic toner with a small particle diameter of 5.5 μm (a two-component developer) was used to form the images. On the basis of the results obtained by this durability test, cleaning performance (toner escape) and blade turning-up were evaluated according to the following criteria.

(a) Cleaning Performance

A: No escape is observed (a case where good images were obtained up to 100,000 sheets).

B: Escape is seen (a case where toner escapes through a roughened surface of the blade to result in defective images due to faulty cleaning).

(b) Blade Turning-Up

GD: (A case where the blade did not turn up until copying on 100,000 sheets.)

NG: (A case in where the blade turned up in the course of copying.)

Example 1

A prepolymer (NCO %: 7%) was prepared from a butylene/hexylene adipate type polyester polyol having a weight average molecular weight of 2,000 and MDI. In this prepolymer, a mixed cross-linking agent of 1,4-butanediol and trimethylol propane (mass ratio: 65:35) was so mixed as to be in a hydroxyl group/NCO molar ratio of 0.95 to prepare a urethane raw material. Using this urethane raw material, a blade (IRHD: 75°) formed from a polyurethane resin in a thickness of 2 mm was made by molding. This blade was made by molding using a centrifugal molding machine. In this molding, the raw material was cured under the conditions of a curing temperature of 130° C. and a curing time of 30 minutes. This blade was bonded to a metal plate to produce a cleaning blade. In this case, the margin for bonding the blade to the plate metal was 5 mm, and the blade was so cut as to be 10 mm in length in its free-length direction.

The cleaning blade obtained was preliminarily dried. After preliminary drying, the cleaning blade was coated with an isocyanate compound MTL (trade name: MILLIONATE MTL; available from Nippon Polyurethane Industry Co., Ltd.) at each end portion of the blade in its lengthwise direction, which was to come into contact with each side region outside the image formation region of the photosensitive drum, to thereby bring that portion into contact with the isocyanate compound. In this case, these were kept in contact for 5 minutes. The excess isocyanate compound remaining on the blade surface was removed with a wiping blade, and thereafter was completely wiped off with a sponge soaked with butyl acetate in a small quantity, followed by drying. After that, this cleaning blade was heated in a hot-air electric oven. In this heating, the heating temperature was 80° C. and the heating time was 30 minutes. The cleaning blade heated was left standing at room temperature for 2 days to obtain a cleaning blade having the high-hardness portion.

The high-hardness portion of the cleaning blade thus obtained was observed at its section with an optical microscope, and it was found that the high-hardness portion was observed as a white opaque layer and the high-hardness portion was in a thickness of 0.07 mm.

Example 2

A cleaning blade was produced in the same way as in Example 1 except that the time of keeping the blade in contact with the isocyanate compound MTL was changed to 100 minutes.

Example 3

A cleaning blade was produced in the same way as in Example 1 except that the urethane raw material was so prepared as to have a hydroxyl group/NCO molar ratio of 0.80, the time of curing in the molding using a centrifugal molding machine was changed to 20 minutes and the time of keeping the blade in contact with the MTL was changed to 100 minutes.

Example 4

A cleaning blade was produced in the same way as in Example 3 except that the time of keeping the blade in contact with the MTL was changed to 100 minutes.

Comparative Example 1

A cleaning blade was produced in the same way as in Example 1 except that the urethane raw material was so prepared as to have a hydroxyl group/NCO molar ratio of 1.00 and the time of keeping the blade in contact with the isocyanate compound MTL was changed to 3 minutes.

Comparative Example 2

A cleaning blade was produced in the same way as in Comparative Example 1 except that the time of keeping the blade in contact with the isocyanate compound MTL was changed to 110 minutes.

Comparative Example 3

A cleaning blade was produced in the same way as in Example 1 except that the urethane raw material was so prepared as to have a hydroxyl group/NCO molar ratio of 0.75, the time of curing in the molding using a centrifugal molding machine was changed to 20 minutes and the time of keeping the blade in contact with the MTL was changed to 3 minutes.

Comparative Example 4

A cleaning blade was produced in the same way as in Comparative Example 3 except that the time of keeping the blade in contact with the isocyanate compound MTL was changed to 110 minutes.

The results obtained are shown in Table 1.

TABLE 1

| | Example | | | | Comparative Example | | | |
|---|---|---|---|---|---|---|---|---|
| | 1 | 2 | 3 | 4 | 1 | 2 | 3 | 4 |
| Contact time (min.) | 5 | 100 | 5 | 100 | 3 | 110 | 3 | 110 |
| | | | Cleaning blade: | | | | | |
| High-hardness portion/ poly-urethane resin portion dynamic hardness ratio | 1.3 | 30 | 1.3 | 30 | 1.2 | 31 | 1.2 | 31 |
| Poly-urethane | 0.05 | 0.05 | 0.16 | 0.16 | 0.04 | 0.04 | 0.17 | 0.17 |

TABLE 1-continued

| | Example | | | | Comparative Example | | | |
|---|---|---|---|---|---|---|---|---|
| | 1 | 2 | 3 | 4 | 1 | 2 | 3 | 4 |
| resin portion dynamic hardness ($mN/\mu m^2$) | | | | | | | | |
| Coefficient of friction | 1.0 | 0.5 | 0.5 | 0.4 | 2.0 | 1.2 | 1.5 | 0.5 |
| | | | Practical test: | | | | | |
| Cleaning performance | A | A | A | A | A | B*1 | A | B*2 |
| Blade turning-up | GD | GD | GD | GD | NG | GD | NG | GD |

*1(blade chipped off)
*2(drum scratched)

As can be seen from Table 1, all the cleaning blades of Examples 1 to 4 were found to show good practical test results. The Rz-jis of the high-hardness portion at its part which comes into contact with the photosensitive drum was 1 μm or less in all cases. In the practical test, the results also show that the cleaning blades of Examples 1 to 4 have sufficient durability.

On the other hand, the cleaning blades of Comparative Examples 1 and 3 had large friction coefficients so that blade turning-up occurred after copying on about 10,000 sheets. The cleaning blades of Comparative Examples 2 and 4 had high ratios of the dynamic hardness of the high-hardness portion to that of the polyurethane resin portion. As a result, in Comparative Example 2, the blade was chipped off at its high-hardness portion during the durability test, and in Comparative Example 4, scratches on the photosensitive drum surface occurred after copying on 10,000 sheets, resulting in faulty images.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-209227, filed Aug. 10, 2007, which is hereby incorporated by reference herein in its entirety.

What is claimed is:

1. An electrophotographic cleaning blade comprising:

a blade formed from a polyurethane resin, which is to come into contact with the surface of a photosensitive drum of an electrophotographic apparatus to remove toner remaining thereon; and a support member which holds the blade, wherein the blade has a polyurethane resin portion having a dynamic hardness of 0.05 $mN/\mu m^2$ or more and 0.16 $mN/\mu m^2$ or less and a high-hardness portion having a dynamic hardness of 1.3 times or more and 30 times or less the dynamic hardness of the polyurethane resin portion, provided at both end portions of the blade in its lengthwise direction where the blade comes into contact with the photosensitive drum.

2. The electrophotographic cleaning blade according to claim 1, wherein the high-hardness portion includes each end portion of the blade that comes into contact with each side region outside an image formation region of the photosensitive drum.

3. The electrophotographic cleaning blade according to claim 1, wherein the high-hardness portion is formed by impregnation with an isocyanate compound, followed by a reaction to effect curing.

4. An electrophotographic apparatus in which a cleaning blade that comes into contact with and rubs against a photosensitive drum to remove toner remaining thereon is set, wherein the cleaning blade is the cleaning blade according to claim 1.

* * * * *